US011294303B2

(12) United States Patent
Ahn et al.

(10) Patent No.: US 11,294,303 B2
(45) Date of Patent: Apr. 5, 2022

(54) TONER REFILL CARTRIDGE WITH PULVERIZATION MEMBER ACTIVATED BY ELASTIC FORCE

(71) Applicant: HEWLETT-PACKARD DEVELOPMENT COMPANY, L.P., Spring, TX (US)

(72) Inventors: Sungchul Ahn, Suwon-si (KR); Seongho Jeong, Suwon-si (KR); Yongil Moon, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/272,745

(22) PCT Filed: Dec. 11, 2019

(86) PCT No.: PCT/US2019/065700

§ 371 (c)(1),
(2) Date: Mar. 2, 2021

(87) PCT Pub. No.: WO2020/256772

PCT Pub. Date: Dec. 24, 2020

(65) Prior Publication Data

US 2021/0318641 A1 Oct. 14, 2021

(30) Foreign Application Priority Data

Jun. 20, 2019 (KR) ..... 10-2019-0073596

(51) Int. Cl.

| | |
|---|---|
| ***G03G 15/08*** | (2006.01) |
| ***G03G 21/00*** | (2006.01) |
| ***G03G 21/16*** | (2006.01) |

(52) U.S. Cl.
CPC ..... *G03G 15/0867* (2013.01); *G03G 15/0894* (2013.01); *G03G 21/1676* (2013.01)

(58) Field of Classification Search
CPC ..... G03G 15/0822; G03G 15/0865; G03G 15/0867; G03G 15/0894; G03G 21/1676
See application file for complete search history.

(56) References Cited

U.S. PATENT DOCUMENTS 6,484,764 B1 11/2002 Wegman et al.
6,862,420 B1 * 3/2005 Less ..... G03G 15/0884 399/258

(Continued)

FOREIGN PATENT DOCUMENTS

CN 107643663 1/2018
EP 0567308 A2 10/1993

(Continued)

*Primary Examiner* — Sophia S Chen
(74) *Attorney, Agent, or Firm* — Trop Pruner & Hu, P.C.

(57) ABSTRACT

An example toner refill cartridge includes a body to contain toner, a toner discharge unit, located at a first end portion of the body in a longitudinal direction, to discharge the toner, a plunger, inserted into the body and movable between a top dead position adjacent to a second end portion of the body and a bottom dead position adjacent to the first end portion, to push the toner toward the toner discharge unit, a locking member, removably coupled with the plunger, to lock the plunger at the top dead position, a pulverization member, including a wing portion extending in a radial direction, coupled with the plunger and movable between a first portion adjacent to the first end portion and a second position adjacent to the second end portion, and an elastic member to apply an elastic force to the pulverization member.

15 Claims, 11 Drawing Sheets

(56) References Cited

U.S. PATENT DOCUMENTS

| | | | | |
|---|---|---|---|---|
| 7,574,160 | B2 | 8/2009 | Jung et al. | |
| 2021/0116838 | A1* | 4/2021 | Ahn | G03G 21/1676 |
| 2021/0229450 | A1* | 7/2021 | Lavigne | G03G 15/0894 |
| 2021/0232062 | A1* | 7/2021 | Choi | G03G 15/0867 |
| 2021/0240101 | A1* | 8/2021 | Moon | G03G 21/1676 |
| 2021/0240107 | A1* | 8/2021 | Lee | G03G 15/0894 |

FOREIGN PATENT DOCUMENTS

| | | | |
|---|---|---|---|
| EP | 1560076 | A2 | 8/2005 |
| JP | 2000019826 | | 1/2000 |
| JP | 2013148831 | | 8/2013 |
| JP | 2013171069 | | 9/2013 |
| KR | 1020060088414 | A | 8/2006 |

* cited by examiner

TONER REFILL CARTRIDGE WITH PULVERIZATION MEMBER ACTIVATED BY ELASTIC FORCE

BACKGROUND

An image forming apparatus using an electrophotographic method supplies toner to an electrostatic latent image formed on a photoconductor to form a visible toner image on the photoconductor, transfers the toner image through an intermediate transfer medium or directly to a printing medium, and fixes the transferred toner image on the printing medium.

A development cartridge contains the toner and provides the toner to the electrostatic latent image formed on the photoconductor to form the visible toner image. When the toner in the development cartridge is consumed, the development cartridge may be removed from the image forming apparatus and a new development cartridge may be mounted in the main body. Also, a toner refill kit (e.g. a toner refill cartridge) may be used to refill new toner in the development cartridge.

DETAILED DESCRIPTION OF EXAMPLES

Figure 1:
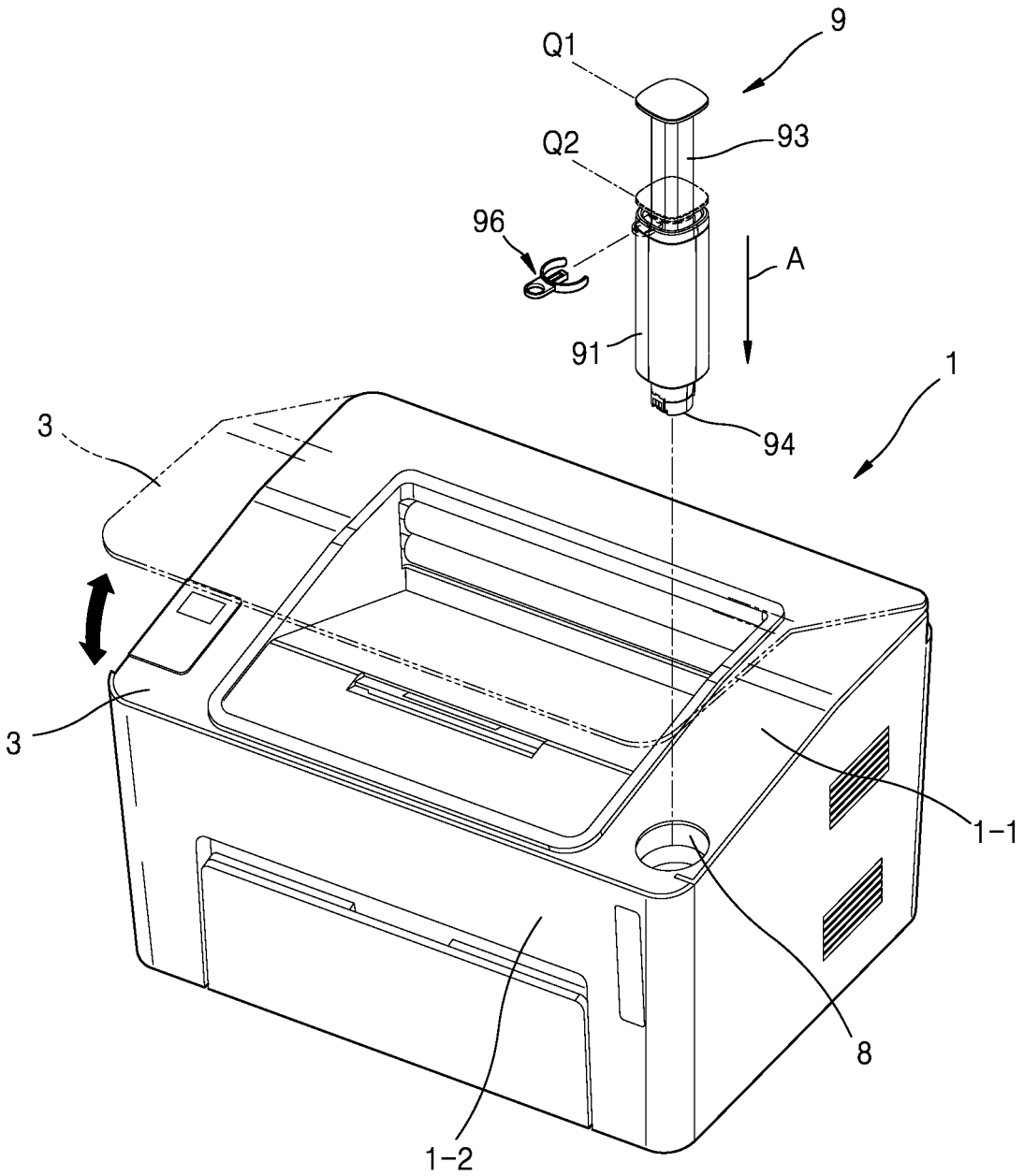
FIG. 1 is a schematic external perspective view of an electrophotographic image forming apparatus according to an example.

Hereinafter, various examples will be described with reference to the drawings. Like reference numerals in the drawings denote like elements, and thus a repetitive description may be omitted.

Figure 2:
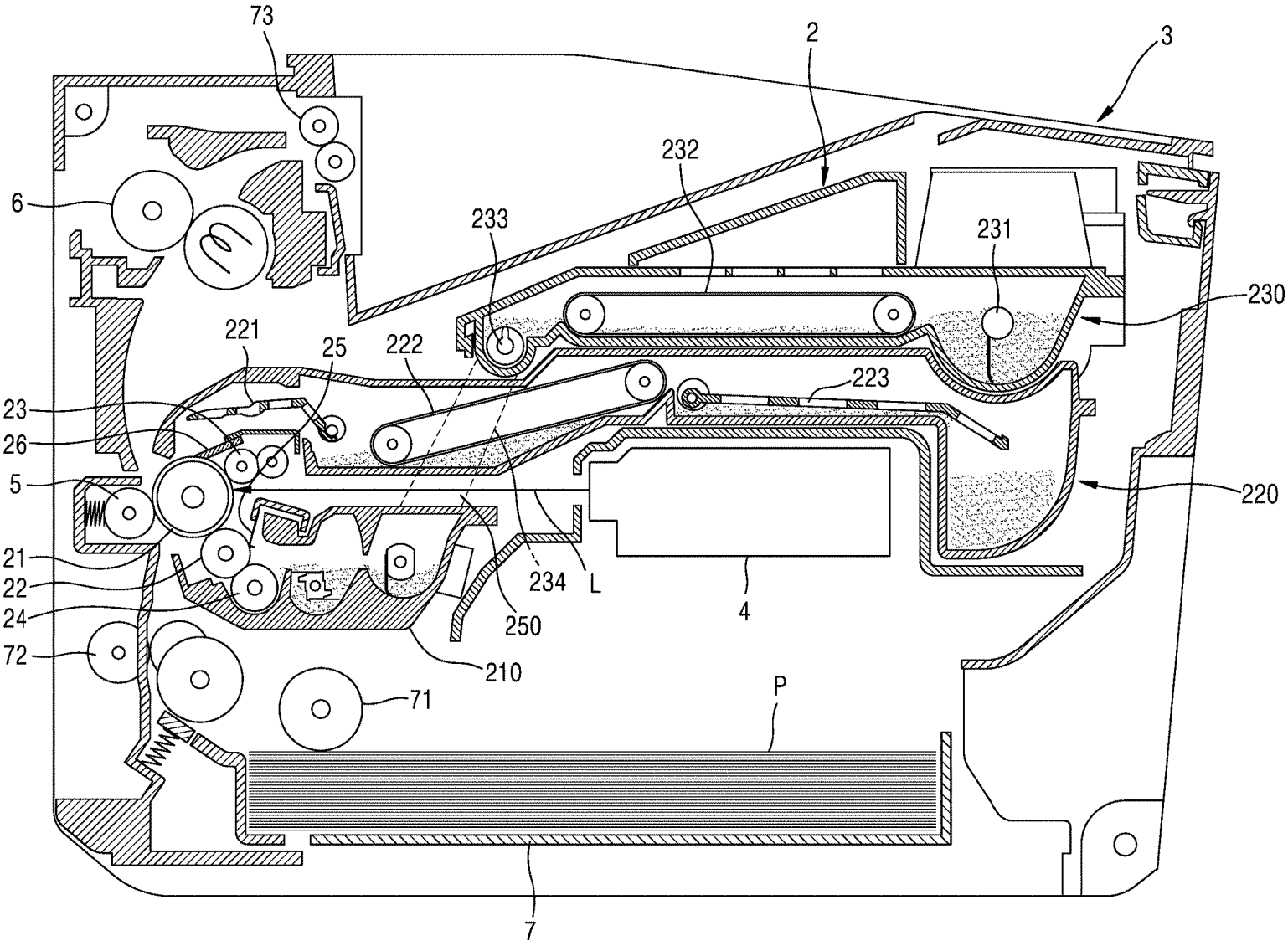
FIG. 2 is a schematic configuration diagram of an electrophotographic image forming apparatus according to an example.
Figure 3:
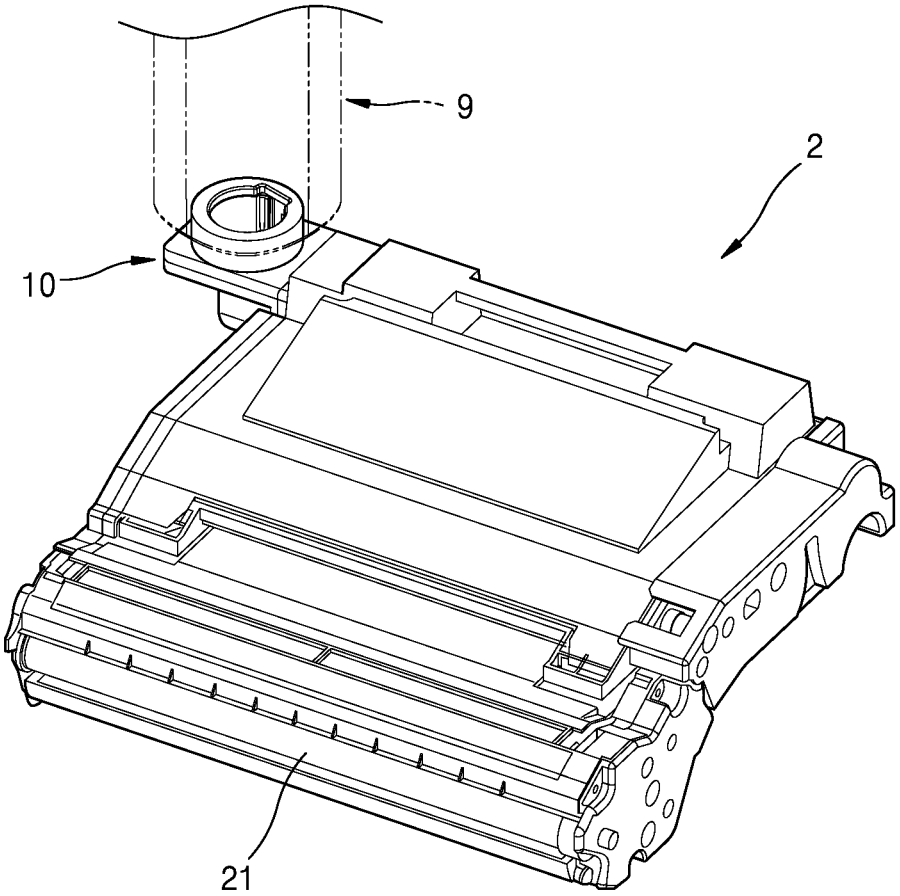
FIG. 3 is a perspective view of a development cartridge according to an example.

FIG. 1 is a schematic external perspective view of an electrophotographic image forming apparatus according to an example. FIG. 2 is a schematic configuration diagram of an electrophotographic image forming apparatus according to an example. FIG. 3 is a perspective view of a development cartridge according to an example.

Referring to FIGS. 1, 2, and 3, an electrophotographic image forming apparatus may include a main body 1 and a development cartridge 2 that may be detachably attached to the main body 1. A door 3 may be provided in the main body 1. The door 3 may open and close a portion of the main body 1. In the example of FIG. 1, the door 3 opens an upper portion of the main body 1. However, a door that opens a side portion or a front portion of the main body 1 may be employed. Based on opening of the door 3, the development cartridge 2 may be attached to or detached from the main body 1.

A photoconductive drum 21, which is an example of a photoconductor on which an electrostatic latent image may be formed, may include a cylindrical metal pipe and a photoconductive layer that is formed on an outer circumference of the cylindrical metal pipe and has photoconductivity. A charging roller 23 is an example of a charger to charge a surface of the photoconductive drum 21 to have a uniform electric potential. A charging bias voltage may be applied to the charging roller 23. In an example, a corona charger (not shown) may be used instead of the charging roller 23. A developing roller 22 may supply toner to an electrostatic latent image formed on the surface of the photoconductive drum 21 and develop the electrostatic latent image.

In the case of a two-component development method in which the toner and a carrier are used as a developer, the developing roller 22 may include a sleeve that rotates and a magnet that is fixedly (e.g., not rotatably) mounted inside the sleeve. The sleeve may be located apart from the photoconductive drum 21 by tens of micrometers to hundreds of micrometers. The carrier may be attached to an outer circumference of the developing roller 22 due to a magnetic force of the magnet and the toner may be attached to the carrier due to an electrostatic force. Thus, a magnetic brush including the carrier and the toner may be formed at the outer circumference of the developing roller 22. In response to a developing bias voltage applied to the developing roller 22, the toner is transported to the electrostatic latent image formed on the photoconductive drum 21.

According to a one-component development method in which the toner is used as a developer, the developing roller 22 may be in contact with the photoconductive drum 21 or located apart from the photoconductive drum 21 by tens of micrometers to hundreds of micrometers. The present example describes a one component contact development method in which the developing roller 22 and the photoconductive drum 21 are in contact with each other and form a development nip. However, this should not be construed as limiting. The developing roller 22 may have a form in which an elastic layer (not shown) is formed at an outer circumference of a conductive metal core (not shown). When the developing bias voltage is applied to the developing roller 22, the toner is transported to the electrostatic latent image formed on the surface of the photoconductive drum 21 via the development nip and attached to the electrostatic latent image.

A supply roller 24 may attach the toner to the developing roller 22. A supply bias voltage may be applied to the supply roller 24 to attach the toner to the developing roller 22. A regulating member 25 is provided to regulate an amount of toner that is attached to the surface of the developing roller 22. The regulating member 25 may be, for example, a regulating blade having a surface in contact with the developing roller 22 due to a predetermined pressure. A cleaning member 26 is provided to remove residual toner and foreign materials from the surface of the photoconductive drum 21 before being charged. The cleaning member 26 may be, for example, a cleaning blade having a surface in contact with the surface of the photoconductive drum 21. Hereinafter, a foreign material removed from the surface of the photoconductive drum 21 is referred to as waste toner.

An optical scanner 4 may irradiate light, which is modified according to image information, on the surface of the photoconductive drum 21 that is charged to have a uniform electric potential. For example, a laser scanning unit (LSU) that deflects light, which is irradiated from a laser diode, in the main scanning direction by using polygon mirrors to scan the light to the photoconductive drum 21 may be employed as the optical scanner 4.

A transfer roller 5 is an example of a transfer unit that is located opposite to the photoconductive drum 21 to form a transfer nip. A transfer bias voltage for transferring the toner image that is developed on the surface of the photoconductive drum 21 to a printing medium P may be applied to the transfer roller 5. A corona transfer unit may be used instead of the transfer roller 5.

The toner image transferred to a surface of the printing medium P by the transfer roller 5 remains on the surface of the printing medium P due to electrostatic attraction. A fixing unit 6 forms a permanent printed image on the printing medium P by applying heat and pressure to the toner image and fixing the toner image on the printing medium P.

Referring to FIGS. 2 and 3, the development cartridge 2 may include a developing portion 210, in which the photoconductive drum 21 and the developing roller 22 are arranged, a waste toner chamber 220, to contain waste toner removed from the photoconductive drum 21, and a toner container 230 that is connected to the developing portion 210 to contain the toner. To refill the toner in the toner container 230, the development cartridge 2 includes a toner refilling portion 10 connected to the toner container 230. The toner refilling portion 10 provides an interface between a toner refill cartridge 9 and the development cartridge 2. The development cartridge 2 is an integral type of development cartridge which includes the developing portion 210, the waste toner chamber 220, the toner container 230, and the toner refilling portion 10.

A portion of an outer circumference of the photoconductive drum 21 is exposed from a housing of the development cartridge 2. The transfer roller 5 may be in contact with the exposed portion of the photoconductive drum 21 to form the transfer nip. One or more conveying members to convey the toner to the developing roller 22 may be arranged in the developing portion 210. The conveying member may agitate the toner to charge the toner to have a predetermined electrical potential.

The waste toner chamber 220 is located above the developing portion 210. The waste toner chamber 220 is apart from the developing portion 210 in an upward direction and forms a light path 250 between the waste toner chamber 220 and the developing portion 210. The waste toner removed from the photoconductive drum 21 by the cleaning member 26 is contained in the waste toner chamber 220. The waste toner removed from the surface of the photoconductive drum 21 is transported into the waste toner chamber 220 by one or more waste toner transporting members 221, 222, and 223. A form and a number of waste toner transporting members are not limited. Considering a volume or the form of waste toner chamber 220, an appropriate number of waste toner transporting members may be arranged at appropriate positions in the waste toner chamber 220 to disperse the waste toner into the waste toner chamber 220.

The toner container 230 is connected to the toner refilling portion 10 and is to contain the toner. As shown by broken lines in FIG. 2, the toner container 230 is connected to the developing portion 210 by a toner supply unit 234. As shown in FIG. 2, the toner supply unit 234 may penetrate the waste toner chamber 220 in a top-down direction and be connected to the developing portion 210. The toner supply unit 234 is located outside of an effective width of exposure light L not to interfere with the exposure light L that is scanned in a main scanning direction by the optical scanner 4.

One or more toner supply members 231, 232, and 233 to supply the toner to the developing portion 210 through the toner supply unit 234 may be arranged in the toner container 230. A form and a number of toner supply members are not limited. Considering a volume or the form of toner container 230, an appropriate number of toner supply members may be arranged at appropriate positions in the toner container 230 to effectively supply the toner to the developing portion 210. The toner supply member 233 may convey the toner in the main scanning direction and deliver the toner to the toner supply unit 234.

An example image forming process according to the above-described configuration will be briefly described. The charging bias voltage is applied to the charging roller 23 and the photoconductive drum 21 is charged to have a uniform electric potential. The optical scanner 4 scans light, which is modulated to correspond to the image information, to the photoconductive drum 21 and forms the electrostatic latent image on the surface of the photoconductive drum 21. The supply roller 24 attaches the toner to the surface of the developing roller 22. The regulating member 25 forms a toner layer having a uniform thickness on the surface of the developing roller 22. The developing bias voltage is applied to the developing roller 22. As the developing roller 22 rotates, the toner conveyed to the development nip is transported to the electrostatic latent image formed on the surface of the photoconductive drum 21 due to the developing bias voltage and attached to the electrostatic image, and a visible toner image is formed on the surface of the photoconductive drum 21. The printing medium P, withdrawn from a load unit 7 by a pickup roller 71, is transported to the transport nip, in which the transfer roller 5 and the photoconductive drum 21 face each other, by a transporting roller 72. When the transfer bias voltage is applied to the transfer roller 5, the toner image is transferred to the printing medium P due to electrostatic attraction. As the toner image transferred to the printing medium P receives heat and pressure from the fixing unit 6 and is fixed on the printing medium P, printing is completed. The printing medium P is discharged by a discharge roller 73. The toner that is not transferred to the printing medium P and remains on the surface of the photoconductive drum 21 is removed by the cleaning member 26.

As described above, the development cartridge 2 may supply toner in the toner container 230 to the electrostatic latent image formed on the photoconductive drum 21 to form the visible toner image and may be detachably attached to the main body 1. In addition, the development cartridge 2 includes the toner refilling portion 10 to refill the toner. The toner refilling portion 10 may be integrally formed with the development cartridge 2 and detachably attached to the main body 1 together with the development cartridge 2. According to an example, the toner may be refilled in the development cartridge 2 in a state where the development cartridge 2 is mounted in the main body 1 without being detached from the main body 1.

Referring again to FIG. 1, the toner refill cartridge 9 may have a form of a syringe type toner refill cartridge including a body 91 to contain toner therein. The toner refill cartridge 9 may include a toner discharge unit 94 and a plunger 93 that is movably combined with the body 91 in a longitudinal direction A to push toner to the outside of the body 91. The toner discharge unit 94 may be provided at a first end portion of the body 91. A discharge shutter that selectively opens or closes the toner discharge unit 94 may be provided at the first end portion of the body 91. In an example toner refill cartridge 9 of the syringe type, the plunger 93 may be located at a top dead position Q1 (see FIG. 1). The plunger 93 may be moved toward a bottom dead position Q2 (see FIG. 1) to refill the toner in the toner container 230.

A communicating portion 8 may be provided in the main body 1 in order to access the toner refilling portion 10 from outside of the main body 1 in a state where the development cartridge 2 is mounted in the main body 1. The communicating portion 8 may be provided at a location near a front portion 1-2 of the main body 1. As the front portion 1-2 faces a user, the user may easily access the communicating portion 8. Therefore, a toner refilling operation through the communicating portion 8 may be easily performed. The communicating portion 8 may be provided on an upper surface 1-1 of the main body 1. The toner refilling portion 10 may be located at a lower portion of the communicating portion 8. The communicating portion 8 and the toner refilling portion 10 may be aligned in a vertical direction. The toner refill cartridge 9 may access the toner refilling portion 10 from above the main body 1 through the communicating portion 8.

In an example, when the toner refill cartridge 9 is inserted into the communicating portion 8 from above the main body 1, the toner refill cartridge 9 may be connected to the toner refilling portion 10 as shown in FIG. 3. When the plunger 93 is pushed in the longitudinal direction A in a state where the toner refill cartridge 9 is mounted in the toner refilling portion 10, toner contained in the body 91 may be discharged through the toner discharge unit 94 and supplied to the toner container 230 of the development cartridge 2 via the toner refilling portion 10. After toner is discharged through the toner discharge unit 94, the toner refill cartridge 9 may be removed from the communicating portion 8.

According to this configuration, the toner may be refilled in the toner container 230 through the toner refilling portion 10. Therefore, a replacement point of the development cartridge 2 may be extended until the photoconductive drum 21 is at or near its end of use, and a printing cost per sheet may be reduced. The toner may be refilled in a state where the development cartridge 2 is mounted in the main body 1, and therefore, user convenience may be improved.

When the toner refill cartridge 9 is stationary for a long period, the toner in the body 91 may become packed. In this state, as the toner has very low fluidity, the toner may not be easily discharged to the toner discharge unit 94 even when the plunger 93 is pushed. When the toner refill cartridge 9 is mounted and a refill operation is performed, the image forming apparatus recognizes that a predetermined amount of toner is refilled in the development cartridge 2. However, when packing of the toner is not properly addressed, an amount of toner less than the predetermined amount may be refilled in the development cartridge 2.

If the toner refill cartridge 9 is subjected to a high temperature or high humidity, the fluidity of the toner within the toner refill cartridge 9 may be insufficient, even when the toner refill cartridge 9 is shaken. A weight member may be put into the body 91 to address packing of the toner. When the user shakes the toner refill cartridge 9, as the weight member moves within the body 91, packing of the toner may be addressed. However, when the user does not sufficiently shake the toner refill cartridge 9 or does not shake the toner refill cartridge 9 at all, packing of the toner may not be addressed.

Figure 4:
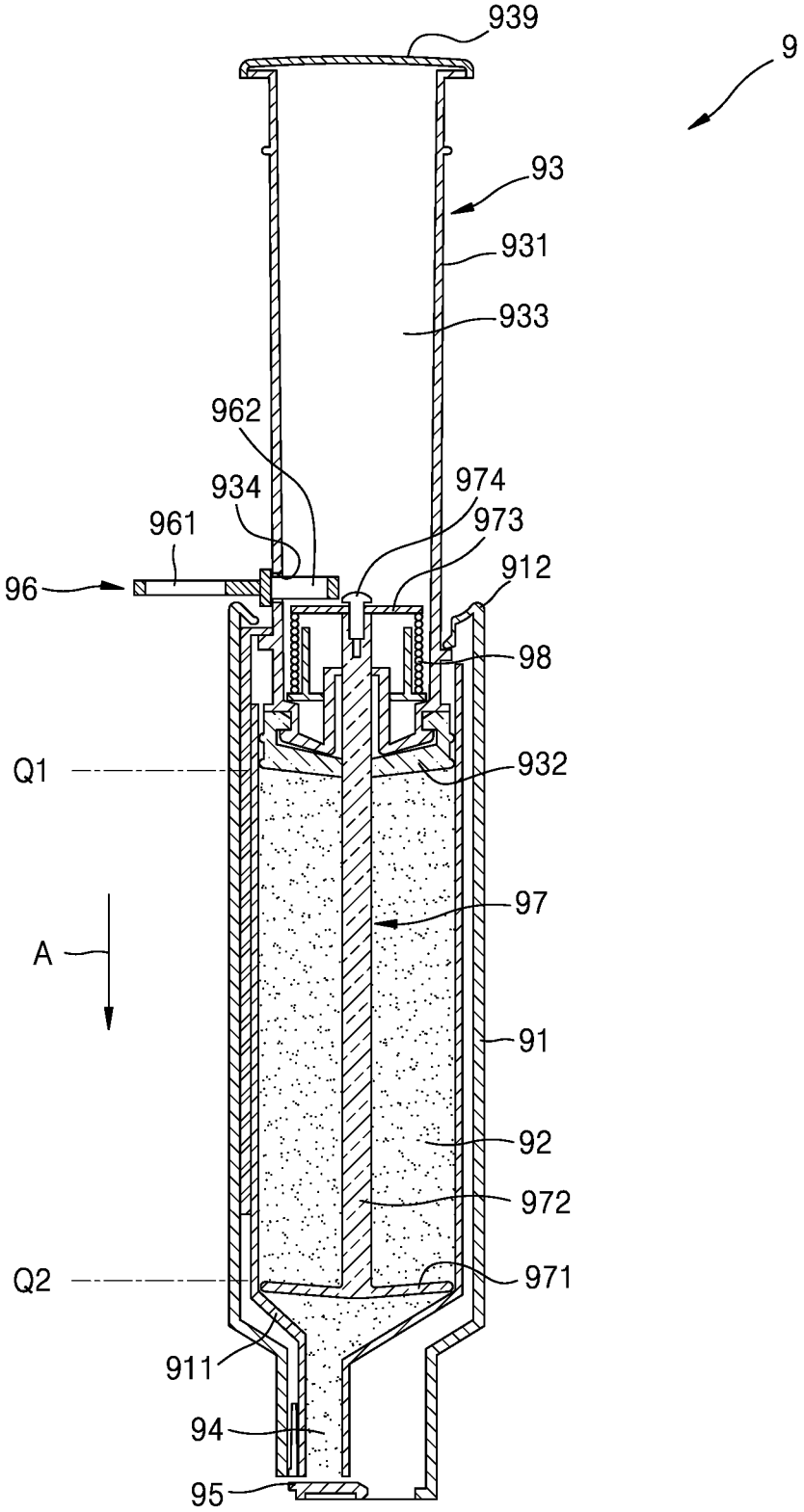
FIG. 4 is a cross-sectional view of a toner refill cartridge according to an example.
Figure 5:
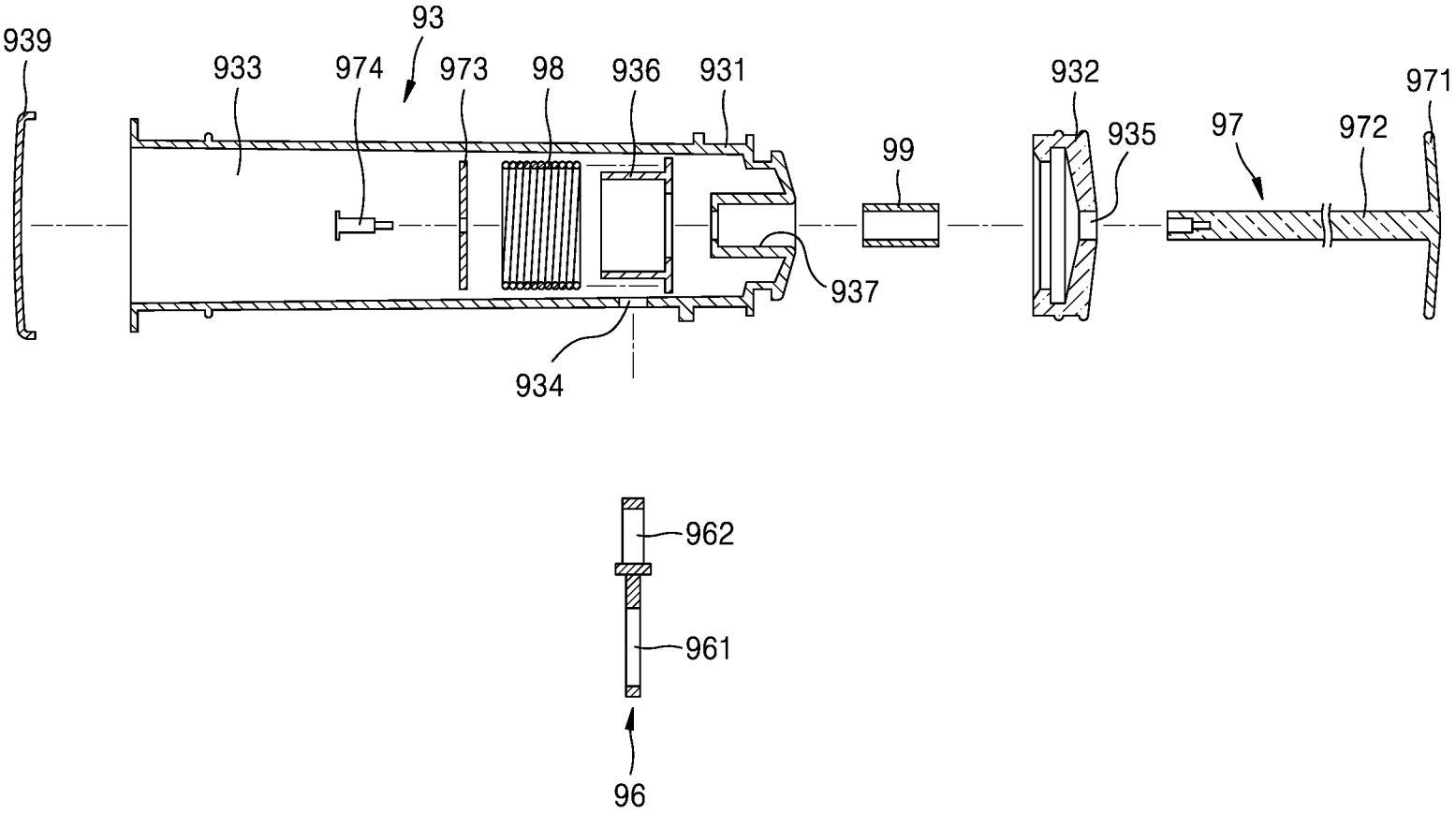
FIG. 5 is a partially exploded cross-sectional view of a toner refill cartridge according to an example.
Figure 6:
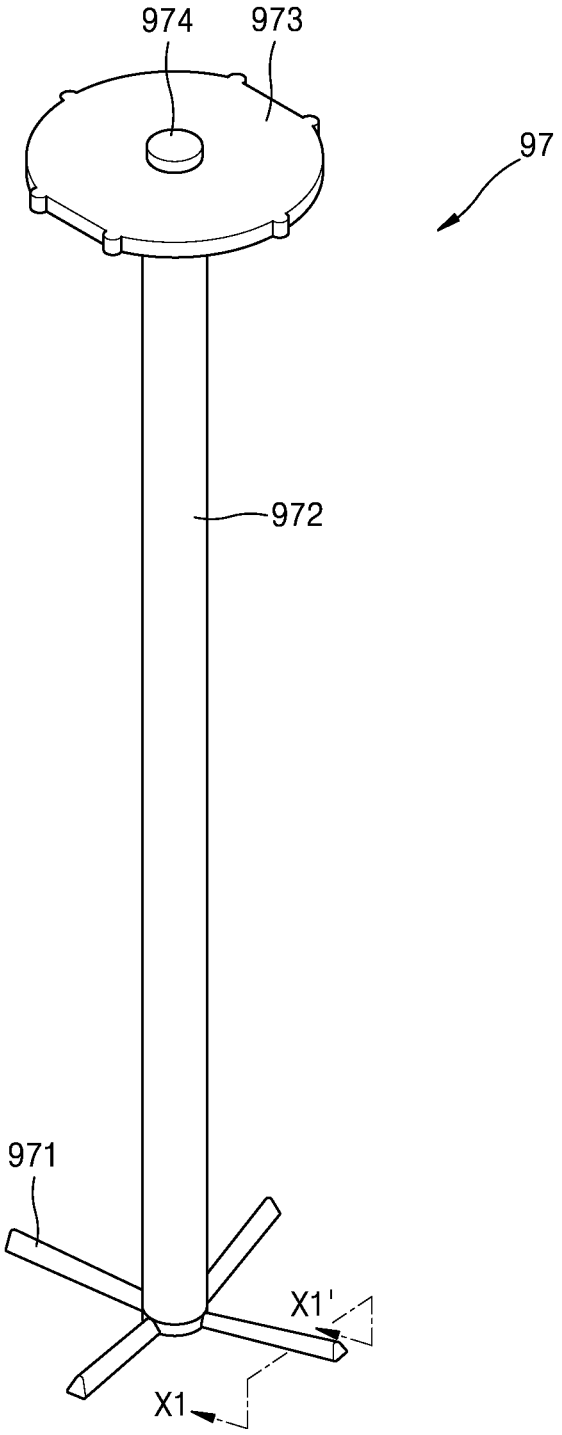
FIG. 6 is a perspective view of a pulverization member according to an example.

FIG. 4 is a cross-sectional view of a toner refill cartridge according to an example. FIG. 5 is a partially exploded cross-sectional view of a toner refill cartridge according to an example. FIG. 6 is a perspective view of a pulverization member according to an example.

Referring to FIGS. 4, 5, and 6, the toner refill cartridge 9 may include the body 91, the plunger 93, a discharge shutter 95, a locking member 96, a pulverization member 97, and an elastic member 98.

The body 91 may contain toner therein. The toner discharge unit 94 that is to discharge toner is provided at a first end portion 911 in the longitudinal direction A of the body 91. For example, the body 91 may include a toner container 92, to contain toner, and the toner discharge unit 94 that may communicate with an outside of the body 91 at an end portion in the longitudinal direction A of the toner container 92, that is, the first end portion 911.

The plunger 93 may be inserted into the body 91 to be movable between the top dead position Q1 adjacent to a second end portion 912 of the body 91 that is opposite to the first end portion 911 in the longitudinal direction A and the bottom dead position Q2 adjacent to the first end portion 911. The plunger 93 may push toner to the outside via the toner discharge unit 94. For example, the plunger 93 may be inserted into the toner container 92 to be movable between the top dead position Q1 and the bottom dead position Q2 in the longitudinal direction A. As an example, the plunger 93 may include a piston 931, which is movable in the longitudinal direction A and includes a hollow portion 933, and a packing member 932 that is provided at an end portion of the piston 931 to push toner toward the toner discharge unit 94 when the piston 931 is moved from the top dead position Q1 toward the bottom dead position Q2. The packing member 932 may include an elastic material such as rubber that is elastically in contact with an inner wall of the toner container 92.

The locking member 96 may be removably coupled with the plunger 93 and may lock the plunger 93 at the top dead position Q1. For example, the locking member 96 may include an insertion bump 962, which is inserted into a locking mouth 934 provided in the piston 931, and a handle 961 that is exposed to the outside of the piston 931. As shown in FIG. 4, when the plunger 93 at the top dead position Q1 is pushed in the longitudinal direction A, the handle 961 may be locked at the second end portion 912 of the body 91. Therefore, the plunger 93 may remain at the top dead position Q1 without being moved in the longitudinal direction A.

The pulverization member 97 includes a wing portion 971 extending in a radial direction in an inner portion of the body 91 and is mounted in the plunger 93 so that the wing portion 971 may be moved between a first position, which is adjacent to the first end portion 911, and a second position adjacent to the second end portion 912 in connection with removal of the locking member 96. The elastic member 98 applies an elastic force to the pulverization member 97 in a direction to move the pulverization member 97 between the first position and the second position.

For example, a penetration hole 935 coupled with or communicating with the hollow portion 933 of the piston 931 may be provided in the packing member 932. The pulverization member 97 may include an elevating mount 972. An end portion of the elevating mount 972 may be inserted into the hollow portion 933 via the penetration hole 935. Another end portion of the elevating mount 972 may be inserted into the inner portion of the body 91, that is, the toner container 92. The wing portion 971 is provided at the other end portion of the elevating mount 972 and may be coupled thereto. The wing portion 971 extends in the radial direction from the other end portion of the elevating mount 972. The present example shows four wing portions 971, but the number of wing portions 971 is not limited thereto.

The elastic member 98 may be located in the hollow portion 933. A fixing plate 973 may be provided at the end portion of the elevating mount 972. The elastic member 98 may include, for example, a compression coil spring supported between the fixing plate 973 and an end portion of the piston 931. A supporting plate 936 that is opposite to the fixing plate 973 to support the elastic member 98 may be provided at the end portion of the piston 931.

An extension portion 937 that is aligned with the penetration hole 935 and extends into the hollow portion 933 may be provided at an end portion of the piston 931 in order that the elevating mount 972 may be inserted into the hollow portion 933. A sealing member 99 to prevent toner from flowing into the hollow portion 933 may be provided in the extension portion 937. The sealing member 99 may have, for example, the form of a ring inserted into the extension portion 937.

According to an example, the end portion of the elevating mount 972 may be inserted into the hollow portion 933 via the penetration hole 935 and the extension portion 937. The supporting plate 936, the elastic member 98, and the fixing plate 973 are sequentially located from another end portion of the piston 931 into the hollow portion 933. The fixing plate 973 may be fixed at the end portion of the elevating mount 972. For example, the fixing plate 973 may be fixed at the end portion of the elevating mount 972 by a screw 974. The insertion bump 962 of the locking member 96 may be inserted into the locking mouth 934 provided in the piston 931 in a state in which the fixing plate 973 compresses the elastic member 98. By doing so, the fixing plate 973 may be locked by the insertion bump 962, and the pulverization member 97 is locked at the first position. As described above, the locking member 96 is removably coupled with the plunger 93 and may control to maintain the pulverization member 97 at the first position. A cover 939 may be combined with the other end portion of the piston 931 to block the hollow portion 933. By doing so, an assembly of the plunger 93 and the pulverization member 97 is realized.

The assembly of the plunger 93 and the pulverization member 97 may be combined with the body 91. The wing portion 971 may be inserted into an inner portion of the body 91, that is, the toner container 92. The packing member 932 may be inserted into the toner container 92. As shown in FIG. 4, the locking member 96 may be locked with the second end portion 912 of the body 91. Thus, the plunger 93 may be locked at the top dead position Q1 and the pulverization member 97 may be locked at the first position.

Figure 7:
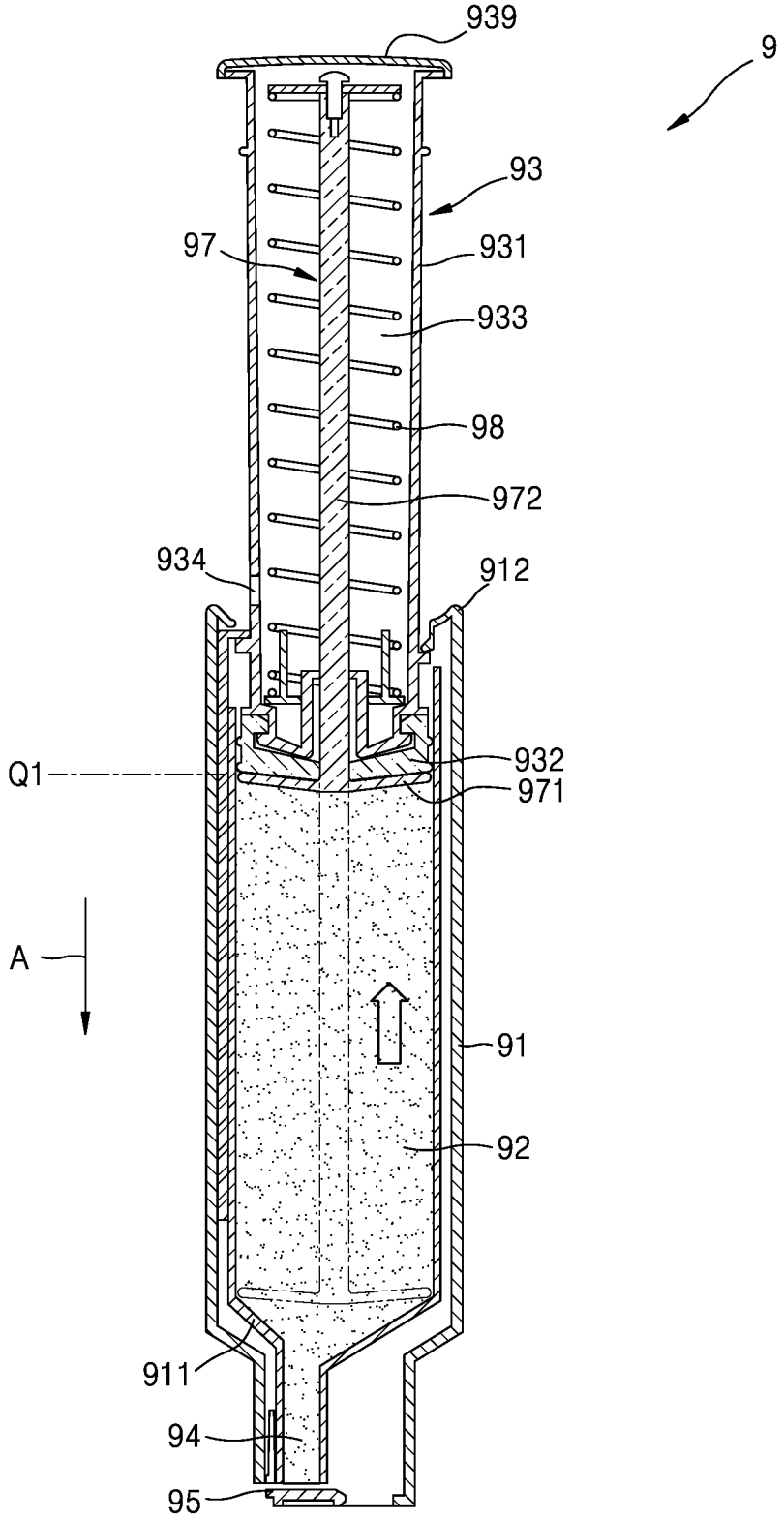
FIG. 7 is a cross-sectional view of a state in which a pulverization member is at a second position according to an example.
Figure 8:
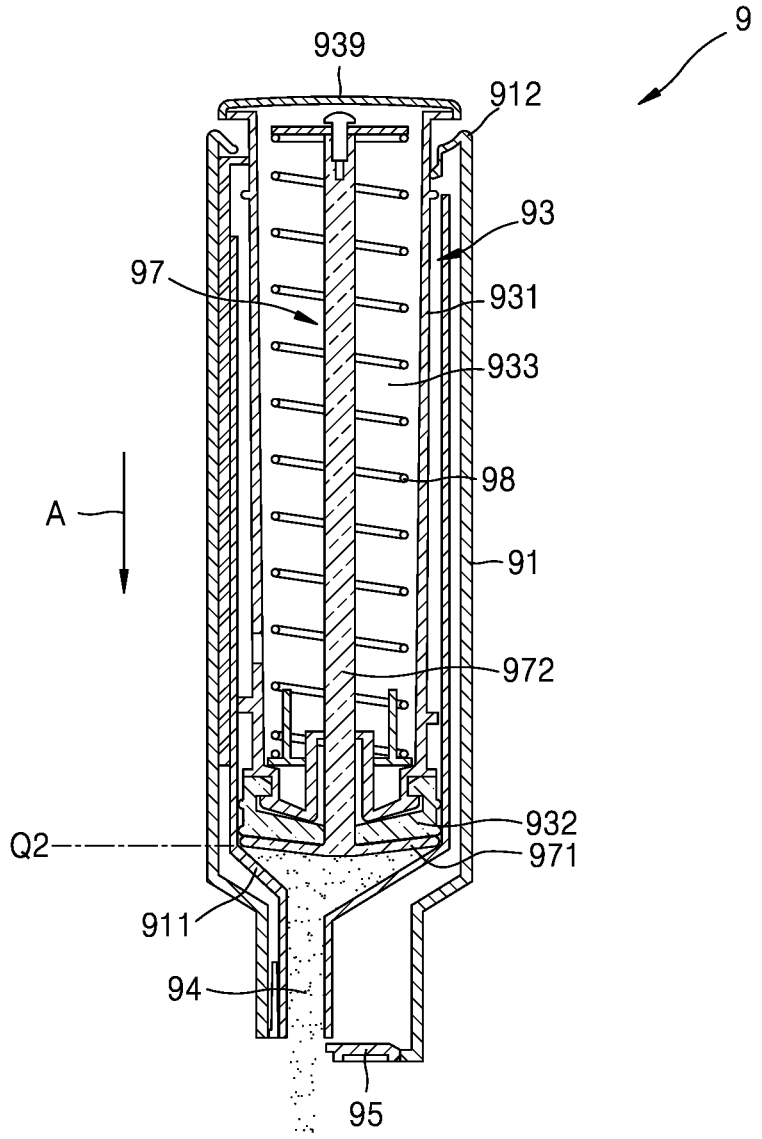
FIG. 8 is a cross-sectional view of a state in which a plunger is at a bottom dead position according to an example.

FIG. 7 is a cross-sectional view of a state in which a pulverization member is at a second position according to an example. FIG. 8 is a cross-sectional view of a state in which a plunger is at a bottom dead position according to an example. A toner refilling process that may be performed by the toner refill cartridge 9 described above will be described with reference to FIGS. 4, 7, and 8.

Referring to FIG. 4, the locking member 96 may be combined with the plunger 93 to lock the plunger 93 at the top dead position Q1, and to lock the pulverization member 97 at the first position. In this state, the locking member 96 may be locked with the second end portion 912 of the body 91 so that, even when the plunger 93 is pushed, the plunger 93 may not be moved toward the bottom dead position Q2.

The locking member 96 may be removed from the plunger 93 before or after inserting the toner refill cartridge 9 into the communicating portion 8 of the main body 1. The handle 961 may be pulled to remove the insertion bump 962 from the locking mouth 934. By doing so, the fixing plate 973 may be released from the insertion bump 962 of the locking member 96, and as the elastic member 98 in a compressed state expands, the elastic member 98 pushes the fixing plate 973 in a direction that is opposite to the longitudinal direction A. As shown in FIG. 7, the wing portion 971 is transported between the first position and the second position. The second position, for example, may be a position at which the wing portion 971 is in contact with the packing member 932. Due to elasticity of the elastic member 98, the wing portion 971 may remain at the second position.

While the wing portion 971 is transported between the first position and the second position, the wing portion 971 passes through the toner in the toner container 92 and addresses packing of the toner. By doing so, fluidity of the toner in the body 91 may increase.

As the locking member 96 is removed from the plunger 93, locking of the plunger 93 is released and the plunger 93 may be moved toward the bottom dead position Q2. As shown in FIG. 8, the plunger 93 may be moved to push toner into the development cartridge 2. As packing of the toner is addressed, the plunger 93 may be more easily moved toward the bottom dead position Q2. Therefore, an amount of residual toner in the body 91 after refill may be reduced.

As described above, by employing the pulverization member 97 moved between the first position and the second position due to the elasticity, packing of the toner contained in the body 91 may be addressed to reduce the amount of residual toner in the body 91.

As a constant amount of toner is refilled into the development cartridge 2, a gauge error of a remaining amount of toner of the image forming apparatus may be reduced or prevented.

By employing the pulverization member 97 that is moved between the first position and the second position in connection with the operation of releasing locking of the plunger 93 by removing the locking member 96 from the plunger 93, the possibility that the user pushes the plunger 93 in a state that packing of the toner is not addressed may be reduced or excluded.

The elastic member 98, which is located in the hollow portion 933, is not externally exposed. As the pulverization member 97 is accommodated in the plunger 93 and the body 91, the pulverization member 97 that is in contact with the toner is not externally exposed in a process of addressing packing of the toner. Therefore, the possibility of polluting the toner refill cartridge 9 or the main body 1 of the image forming apparatus due to toner leakage may be reduced. The possibility of toner leakage may be reduced by employing the sealing member 99. The cover 939 that covers the hollow portion 933 of the plunger 93 may be employed to further reduce the possibility of toner leakage.

In the example described above, the locking member 96 has both a function of having the plunger 93 locked at the top dead position Q1 and a function of having the pulverization member 97 locked at the first position. However, the locking member 96 may only have the function of having the pulverization member 97 locked at the first position. Accordingly, packing of the toner may be addressed by a simple operation of removing the locking member 96, and thus, user convenience may be improved as compared to addressing toner packing by an operation such as shaking the toner refill cartridge 9. In addition, in this case, an extra locking member to have the plunger 93 locked at the top dead position Q1 may be employed.

Figure 9:
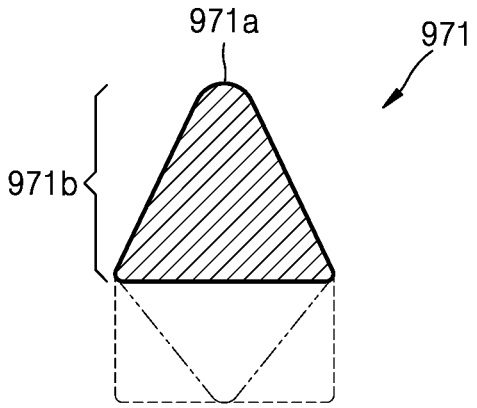
FIG. 9 is a cross-sectional view taken along line X1-X1' shown in FIG. 6 according to an example.

FIG. 9 is a cross-sectional view taken along line X1-X1' shown in FIG. 6 according to an example.

Referring to FIG. 9, the wing portion 971 may have a cross-section reduction portion 971*b* having a width that gradually decreases along an upper end portion 971*a* that faces the second end portion 912 of the body 91. According to this configuration, the pulverization member 97 may be easily moved between the first position and the second position through the toner.

In an example, the upper end portion 971*a* of the wing portion 971 may have a round shape. The wing portion 971 may be moved toward the second position until the upper end portion 971*a* is in contact with the packing member 932. At this time, when toner accumulates on the upper end portion 971*a* of the wing portion 971, the toner may be jammed between the upper end portion 971*a* of the wing portion 971 and the packing member 932. Thus, the wing portion 971 and the packing member 932 may be spaced apart from each other. The plunger 93 may be moved toward the bottom dead position Q2 until the wing portion 971 touches the first end portion 911 of the body 91, and when the wing portion 971 and the packing member 932 are away from each other, the plunger 93 may not be completely moved to the bottom dead position Q2. According to an example, as the upper end portion 971*a* of the wing portion 971 has a round shape, the toner slips from the upper end portion 971*a*. Therefore, the possibility that the toner will accumulate on the upper end portion 971*a* may be reduced. Accordingly, the plunger 93 may be stably moved toward the bottom dead position Q2.

In an example, the wing portion 971 may have a portion having a uniform width at an opposite side of the cross-section reduction portion 971*b* as shown by a broken line in FIG. 9, or a portion having a width that gradually decreases as shown in an alternating long and short dash line as shown in FIG. 9. Although not shown in the drawing, the cross-section of the wing portion 971 may have various shapes such as a circle or an oval in which a long shaft faces the first end portion 911 and the second end portion 912 of the body 91.

Figure 10:
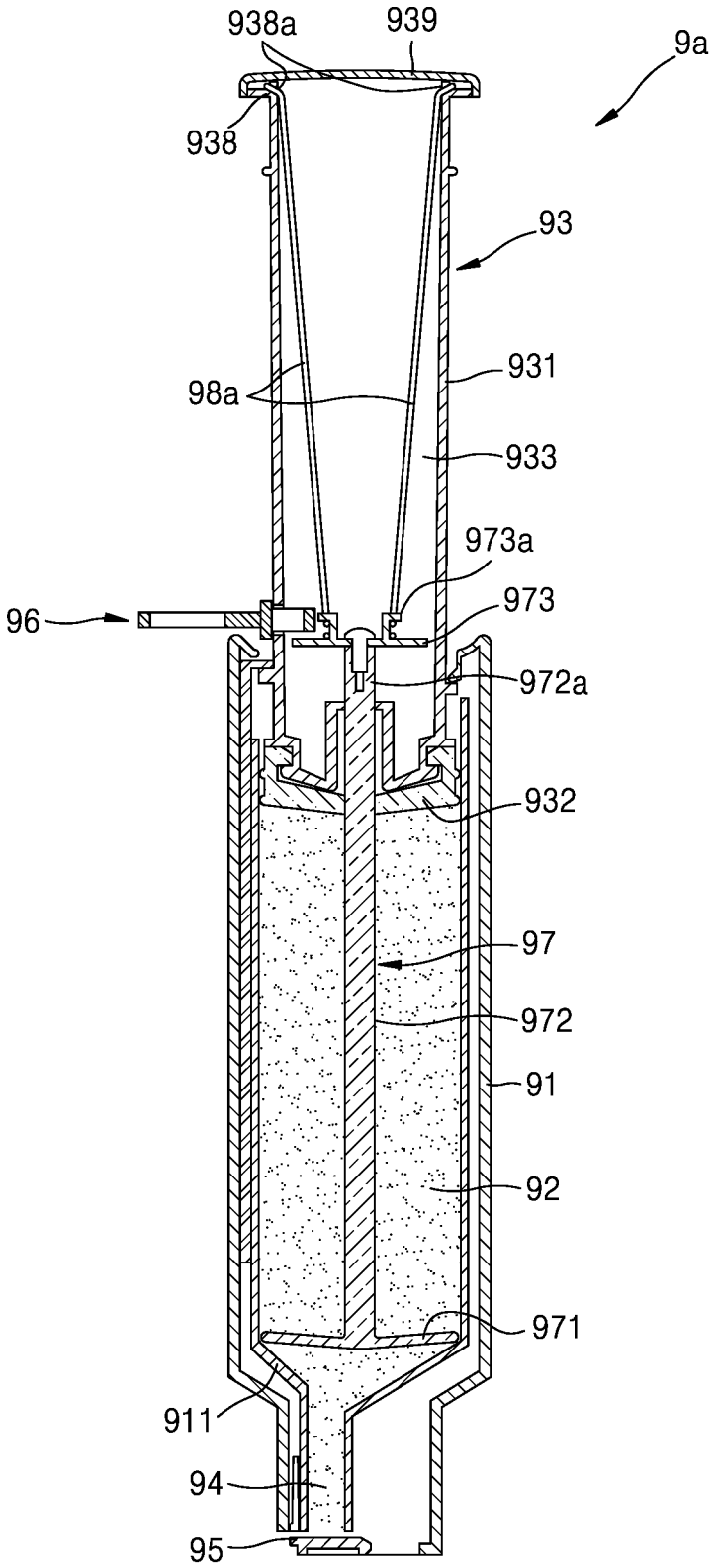
FIG. 10 is a cross-sectional view of a toner refill cartridge according to an example.

FIG. 10 is a cross-sectional view of a toner refill cartridge according to an example.

Referring to FIG. 10, a toner refill cartridge 9*a* employs an elastic band 98*a* as an elastic member. Additional elements illustrated in FIG. 10 that are the same as the elements shown in FIGS. 4 through 8 are marked with the same reference numerals and a repeated description thereof will be omitted.

As illustrated in FIG. 10, the elastic band 98*a* may be attached or otherwise secured at an end portion 938 of the piston 931. The end portion 938 may be an end portion opposite to the end portion at which the packing member 932 is arranged. The elastic band 98*a* may also be attached or otherwise secured at an end portion 972*a* of the elevating mount 972, that is, an end portion opposite to the wing portion 971. A locking jaw 938*a* at which the elastic band 98*a* may be attached or otherwise secured may be provided at the other end portion 938 of the piston 931. The fixing plate 973 may be combined with the end portion 972*a* of the elevating mount 972, and a locking jaw 973*a*, at which the elastic band 98*a* is attached or otherwise secured, may be provided on the fixing plate 973. One or more elastic bands 98*a* may be employed. When the pulverization member 97 is at the first position, the elastic band 98*a* is under tensile force and applies elasticity to the pulverization member 97 to be moved toward the second position. When the locking member 96 is removed from the plunger 93, the elastic band 98*a* contracts. Therefore, due to an elastic restoring force of the elastic band 98*a*, the pulverization member 97 may be moved between the first position and the second position.

Figure 11:
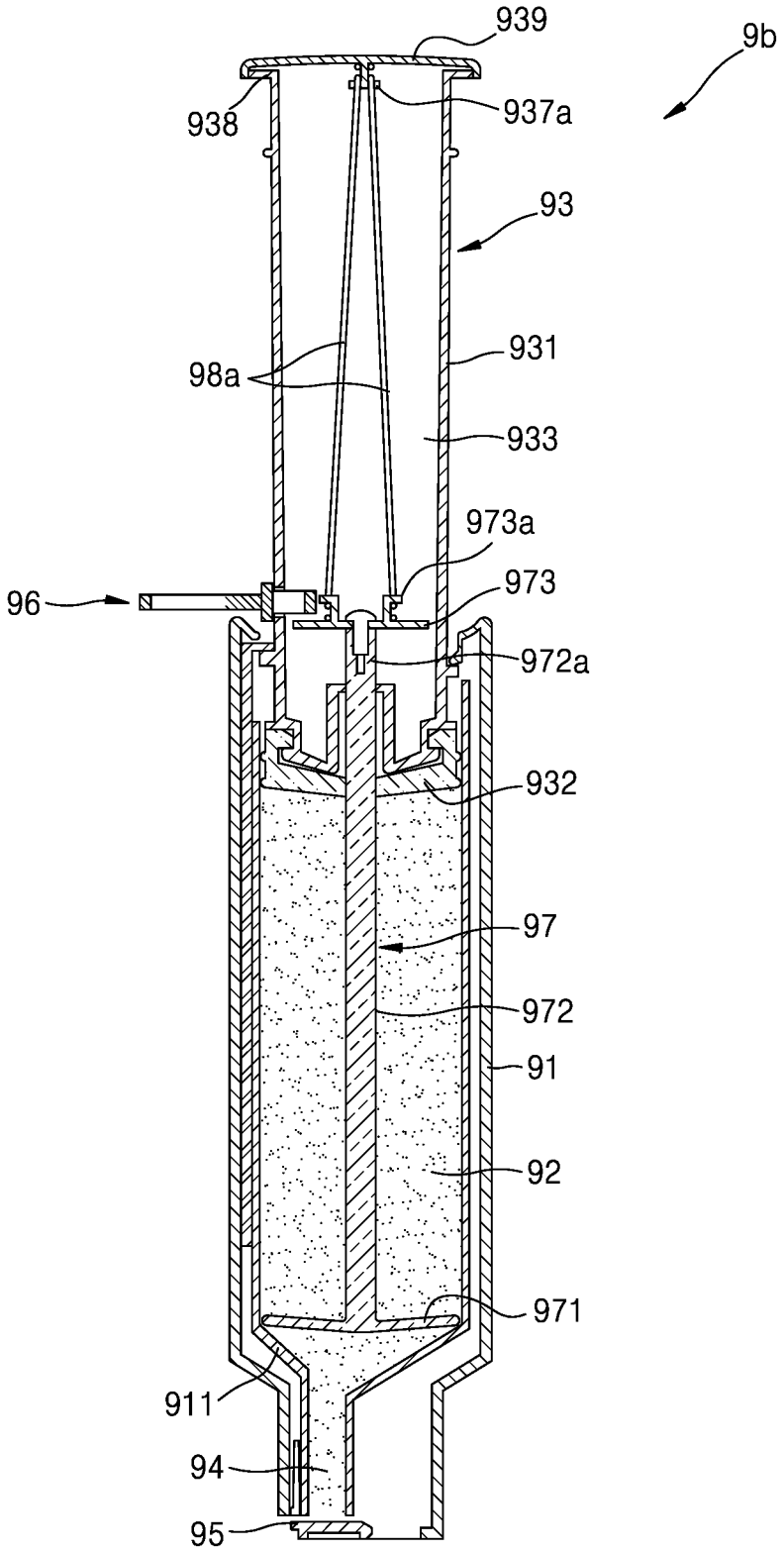
FIG. 11 is a cross-sectional view of a toner refill cartridge according to an example.

FIG. 11 is a cross-sectional view of a toner refill cartridge according to an example.

Referring to FIG. 11, a toner refill cartridge 9*b* employs the elastic band 98*a* as an elastic member and provides the locking jaw 937*a*, at which the elastic band 98*a* is attached or otherwise secured, at the cover 939. Additional elements illustrated in FIG. 11 that are the same as the elements shown in FIGS. 4 through 8 and 10 are marked with same reference numerals and repeated descriptions thereof will be omitted.

As illustrated in FIG. 11, the elastic band 98*a* is attached or otherwise secured at the other end portion 938 of the piston 931, that is, an end portion opposite to the end portion at which the packing member 932 is arranged, and the end portion 972*a* of the elevating mount 972, that is, an end portion opposite to the wing portion 971. The locking jaw 973*a* may be provided at the cover 939 that covers the other end portion 938 of the piston 931 for the elastic band 98*a* to be attached or otherwise secured. The fixing plate 973 may be combined with the end portion 972*a* of the elevating mount 972, and the locking jaw 973*a* at which the elastic band 98*a* is attached or otherwise secured may be provided on the fixing plate 973. One or more elastic bands 98*a* may be employed. When the pulverization member 97 is at the first position, the elastic band 98*a* is under tensile force and applies elasticity to the pulverization member 97 to be moved toward the second position. When the locking member 96 is removed from the plunger 93, the elastic band 98*a* contracts. Therefore, due to an elastic restoring force of the elastic band 98*a*, the pulverization member 97 may be moved between the first position and the second position.

It should be understood that examples described herein should be considered in a descriptive sense only and not for purposes of limitation. Descriptions of features or aspects within each example should typically be considered as available for other similar features or aspects in other embodiments. While one or more examples have been described with reference to the figures, it will be understood by those of ordinary skill in the art that various changes in form and details may be made therein without departing from the spirit and scope as defined by the following claims.

What is claimed is:

1. A toner refill cartridge comprising:

a body to contain toner;

a toner discharge unit located at a first end portion of the body in a longitudinal direction, the toner discharge unit to discharge the toner;

a plunger inserted into the body and movable between a top dead position adjacent to a second end portion of the body, which is opposite to the first end portion, and a bottom dead position adjacent to the first end portion, the plunger to push the toner toward the toner discharge unit;

a locking member removably coupled with the plunger, the locking member to lock the plunger at the top dead position;

a pulverization member comprising a wing portion extending in a radius radial direction, the pulverization member coupled with the plunger and movable between a first position adjacent to the first end portion and a second position adjacent to the second end portion; and an elastic member to apply an elastic force to the pulverization member to move the pulverization member toward the second position.

2. The toner refill cartridge of claim 1, wherein the wing portion comprises a cross-section reduction portion having a cross-sectional area that gradually decreases along an upper end portion that faces the second end portion of the body.

3. The toner refill cartridge of claim 2, wherein the upper end portion of the wing portion that faces the second end portion of the body has a round shape.

4. The toner refill cartridge of claim 1, wherein the locking member is to lock the pulverization member at the first position.

5. The toner refill cartridge of claim 4, wherein the plunger comprises:

a piston movable in the longitudinal direction and comprising a hollow portion; and a packing member located at an end portion of the piston to push the toner toward the toner discharge unit when the piston is moved toward the bottom dead position, the packing member comprising a penetration hole coupled with the hollow portion, wherein the pulverization member comprises:

an elevating mount having an end portion to insert into the hollow portion through the penetration hole, wherein the wing portion is coupled to the elevating mount at another end portion; and a fixing plate provided at the end portion of the elevating mount, and wherein the elastic member comprises a compression coil spring supported between the end portion of the piston and the fixing plate.

6. The toner refill cartridge of claim 5, wherein the locking member is to lock at the fixing plate.

7. The toner refill cartridge of claim 5, further comprising:

an extension portion, aligned with the penetration hole and extending into the hollow portion such that the elevating mount is inserted, the extension portion located at the end portion of the piston; and a sealing member, located in the extension portion, to prevent flow of the toner into the hollow portion.

8. The toner refill cartridge of claim 5, further comprising:

a cover, combined with another end portion of the piston, to block the hollow portion.

9. The toner refill cartridge of claim 5, further comprising a screw to combine the fixing plate with another end portion of the elevating mount.

10. The toner refill cartridge of claim 4, wherein the plunger comprises:

a piston movable in the longitudinal direction and comprising a hollow portion; and a packing member located at an end portion of the piston to push the toner toward the toner discharge unit when the piston is moved toward the bottom dead position, the packing member comprising a penetration hole coupled with the hollow portion, wherein the pulverization member comprises an elevating mount having an end portion to insert into the hollow portion through the penetration hole and another end portion at which the wing portion is provided, and wherein the elastic member comprises an elastic band that is attached at the piston and the elevating mount.

11. A toner refill cartridge comprising:

a body comprising a toner container to contain toner and a toner discharge unit located at an end portion in a longitudinal direction of the toner container;

a plunger inserted into the toner container and movable in the longitudinal direction between a top dead position and a bottom dead position to discharge the toner via the toner discharge unit;

a pulverization member comprising an elevating mount extending in the longitudinal direction and a wing portion extending in a radial direction from the elevating mount, the wing portion located in the plunger and movable between a first position adjacent to the toner discharge unit and a second position adjacent to a lower portion of the plunger;

an elastic member to apply an elastic force to the pulverization member to move the pulverization member toward the second position; and a locking member removably coupled with the plunger to lock the pulverization member so that the pulverization member is locked at the first position.

12. The toner refill cartridge of claim 11, wherein the plunger comprises:

a piston movable in the longitudinal direction and comprising a hollow portion; and a packing member located at an end portion of the piston to push the toner toward the toner discharge unit when the piston is moved toward the bottom dead position, the packing member comprising a penetration hole coupled with the hollow portion, wherein an end portion of the elevating mount is inserted into the hollow portion through the penetration hole and the wing portion is provided at another end portion of the elevating mount.

13. The toner refill cartridge of claim 12, wherein the elastic member is located in the hollow portion.

14. The toner refill cartridge of claim 12, wherein the wing portion comprises a cross-section reduction portion having a cross-sectional area that gradually decreases along an upper end portion that faces the packing member.

15. The toner refill cartridge of claim 11, wherein the locking member is to lock the plunger at the top dead position.

* * * * *